US010234784B2

(12) United States Patent
Kamiyoshi et al.

(10) Patent No.: US 10,234,784 B2
(45) Date of Patent: Mar. 19, 2019

(54) LIQUID DEVELOPER

(71) Applicant: Kao Corporation, Tokyo (JP)

(72) Inventors: Nobumichi Kamiyoshi, Wakayama (JP); Tatsuya Yamada, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/735,771

(22) PCT Filed: May 20, 2016

(86) PCT No.: PCT/JP2016/065062
§ 371 (c)(1),
(2) Date: Dec. 12, 2017

(87) PCT Pub. No.: WO2017/002480
PCT Pub. Date: Jan. 5, 2017

(65) Prior Publication Data

US 2018/0181017 A1 Jun. 28, 2018

(30) Foreign Application Priority Data

Jun. 30, 2015 (JP) ..... 2015-131410

(51) Int. Cl.

| | |
|---|---|
| ***G03G 9/00*** | (2006.01) |
| ***G03G 9/13*** | (2006.01) |
| ***G03G 9/135*** | (2006.01) |
| ***G03G 9/12*** | (2006.01) |
| ***G03G 9/08*** | (2006.01) |
| ***G03G 9/125*** | (2006.01) |

(52) U.S. Cl.
CPC ..... *G03G 9/132* (2013.01); *G03G 9/081* (2013.01); *G03G 9/12* (2013.01); *G03G 9/125* (2013.01); *G03G 9/13* (2013.01); *G03G 9/135* (2013.01)

(58) Field of Classification Search
CPC ..... G03G 9/135; G03G 9/125; G03G 9/132
USPC ..... 430/115, 116
See application file for complete search history.

(56) References Cited

U.S. PATENT DOCUMENTS

| | | | |
|---|---|---|---|
| 2014/0186764 | A1 | 7/2014 | Yamada et al. |
| 2014/0320576 | A1 | 10/2014 | Bar-Haim et al. |

FOREIGN PATENT DOCUMENTS

| | | | |
|---|---|---|---|
| EP | 2749955 | | 7/2014 |
| JP | 49-6232 | B1 | 1/1974 |
| JP | 2002-251040 | A | 9/2002 |
| JP | 2013-130791 | A | 7/2013 |
| JP | 2013-190657 | A | 9/2013 |
| JP | 2014-142624 | A | 8/2014 |
| JP | 2015-513114 | A | 4/2015 |
| JP | 2015-125297 | A | 7/2015 |
| JP | 2015-184496 | A | 10/2015 |

OTHER PUBLICATIONS

International Search Report dated Aug. 16, 2016 in PCT/JP2016/065062, citing documents AO through AS therein, 2 pages.
Extended European Search Report dated Dec. 20, 2018, corresponding for European Patent Application No. 16817589.1.

*Primary Examiner* — Mark A Chapman
(74) *Attorney, Agent, or Firm* — Oblon, McClelland, Maier & Neustadt L L P

(57) ABSTRACT

A liquid developer containing toner particles containing a resin containing a polyester and a pigment, wherein the toner particles are dispersed in an insulating liquid in the presence of a dispersant, wherein the insulating liquid has an evaporation rate after holding at 40° C. for 30 minutes of less than 0.26% by mass; and a method for producing a liquid developer containing toner particles containing a resin containing a polyester and a pigment, wherein the toner particles are dispersed in an insulating liquid in the presence of a dispersant, including: step 1: melt-kneading a resin containing a polyester and a pigment, and pulverizing a kneaded product obtained, to provide toner particles; step 2: adding a dispersant to the toner particles obtained in the step 1, and dispersing the toner particles in an insulating liquid to provide a dispersion of toner particles, and step 3: subjecting the dispersion of toner particles obtained in the step 2 to wet-milling, to provide a liquid developer, wherein the insulating liquid has an evaporation rate after holding at 40° C. for 30 minutes of less than 0.26% by mass. The liquid developer of the present invention is suitably used, for example, in development or the like of latent images formed in electrophotography, electrostatic recording method, electrostatic printing method or the like.

17 Claims, No Drawings

LIQUID DEVELOPER

FIELD OF THE INVENTION

The present invention relates to a liquid developer usable in development of latent images formed in, for example, electrophotography, electrostatic recording method, electrostatic printing method or the like, and a method for producing the same.

BACKGROUND OF THE INVENTION

As electrophotographic developers, a dry developer in which toner components composed of materials containing a colorant and a resin binder are used in a dry state, and a liquid developer in which toner components are dispersed in an insulating liquid have been known.

In a liquid developer, toner particles are dispersed in oil in an insulating liquid, thereby making it possible to form smaller particle sizes as compared to a dry developer. Therefore, high-quality printouts can be obtained surpassing offset printing, so that the liquid developer is suitable for commercial printing applications. However, liquid developers having low-temperature fusing ability of the toner, from the viewpoint of conservation of energy, and having even more excellent storage stability, from the viewpoint of a long-term storage have been desired.

In addition, in the recent years, with the increased awareness of environmental friendliness, an insulating liquid having a low volatility has been used as a dispersion medium for a liquid developer.

Patent Publication 1 discloses, for the purposes of providing a liquid developer being well dispersible, having a high image density, stably giving high-resolution, high-chroma fused images, and having controlled generation of a solvent steam during fusing, a liquid developer for electrostatic photography containing toner particles composed of a colorant and a resin, wherein the toner particles are dispersed in a carrier liquid having a high-resistant dielectric constant, the liquid developer for electrostatic image characterized in that the above carrier liquid contains at least one organic medium selected from (a) a naphthene solvent having an initial boiling point of 150° C. or higher and (b) a monoester formed between an alcohol having 3 or more carbon atoms and a fatty acid having 5 or more carbon atoms. Also, the patent publication discloses a naphthene hydrocarbon usable as the organic medium, such as Exxsol D80, Exxsol D110, and Exxsol D130 hereinabove manufactured by Exxon Mobile Corporation, etc.

Patent Publication 2 discloses a liquid developer comprising at least a resin binder, a colorant, a polymeric dispersant, and a carrier liquid, as a liquid developer having excellent color developing ability and color reproducibility, and having a stable dispersion state of the toner particles in the liquid developer and a stable optical density even with an increase in the number of printouts or printed area, and having a stable optical density without going through any changes in the developer composition for a long period of time. Also, the patent publication discloses that a preferred carrier liquid is a naphthene hydrocarbon such as Exxsol D80, Exxsol D110, or Exxsol D130 hereinabove manufactured by Exxon Mobile Corporation.

Patent Publication 1: Japanese Patent Laid-Open No. 2002-251040

Patent Publication 2: Japanese Patent Laid-Open No. 2013-130791

SUMMARY OF THE INVENTION

The present invention relates to:

[1] a liquid developer containing toner particles containing a resin containing a polyester and a pigment, wherein the toner particles are dispersed in an insulating liquid in the presence of a dispersant, wherein the above insulating liquid has an evaporation rate after holding at 40° C. for 30 minutes of less than 0.26% by mass;

[2] use of an insulating liquid having an evaporation rate after holding at 40° C. for 30 minutes of less than 0.26% by mass as a medium for a liquid developer; and

[3] a method for producing a liquid developer containing toner particles containing a resin containing a polyester and a pigment, wherein the toner particles are dispersed in an insulating liquid in the presence of a dispersant, including:

step 1: melt-kneading a resin containing a polyester and a pigment, and pulverizing a kneaded product obtained, to provide toner particles;

step 2: adding a dispersant to the toner particles obtained in the step 1, and dispersing the toner particles in an insulating liquid to provide a dispersion of toner particles; and step 3: subjecting the dispersion of toner particles obtained in the step 2 to wet-milling, to provide a liquid developer, wherein the above insulating liquid has an evaporation rate after holding at 40° C. for 30 minutes of less than 0.26% by mass.

DETAILED DESCRIPTION OF THE INVENTION

Further, a new problem that a printing apparatus halts by long-term operations in a liquid developer using a low-volatile insulating liquid has been found.

In view of the above, after having studied on the causations thereof, the present inventors have elucidated that low-molecular weight components contained in the insulating liquid are evaporated, so that corona charger contamination caused by decomposition products, oxides or the like are generated, whereby consequently the printing apparatus halts by an electric short-circuit.

Specifically, the present invention relates to a liquid developer that does not affect the printing apparatus even in long-term operations, and a method for producing the same.

The liquid developer of the present invention exhibits some effects that would not affect the printing apparatus even in long-term operations.

The liquid developer of the present invention is a liquid developer containing toner particles containing a resin containing a polyester and a pigment, wherein the toner particles are dispersed in an insulating liquid in the presence of a dispersant, and the liquid developer has a very low volatility, and corona charger contamination can be controlled even in a long-term use, so that the printing apparatus is not affected at all.

Although the reasons why such effects are exhibited are not certain, they are considered to be as follows.

In the present invention, corona charger contamination refers to accumulation of organic compounds formed by decomposition or oxidation of low-molecular weight components contained in a trace amount in the insulating liquid on a wire surface of the charger provided in the vicinity of a photoconductive roller for charging a surface of a photoconductor. As a result of causation of corona charger contamination, errors such as electric short-circuits or operating halts of the printing apparatus (or not operating normally) are generated.

However, in the present invention, since an insulating liquid having a very low volatility is used, the corona charger contamination can be prevented.

Here, the presence or absence of this corona charger contamination can be judged by visually recognizing with visual observations or electron microphotographs of a wire surface. Alternatively, as described in Examples, the presence or absence can be judged from a change in surface potentials on a photoconductive roller when operated under specified environmental conditions. In other words, a large change in surface potentials can be assumed to have accumulated organic compounds mentioned above on a wire surface of the charger. Here, the presence or absence of the corona charger contamination by visual observations can be judged by the presence or absence of the adhesion of organic compounds on a cotton waste after wiping a wire surface with a cotton waste immersed in acetone.

[Resin]

The resin usable in the present invention is a resin binder for toner particles. The resin contains a polyester, from the viewpoint of improving pulverizability of the toner particles, thereby capable of forming smaller particle sizes, from the viewpoint of improving low-temperature fusing ability of the toner, and from the viewpoint of improving dispersion stability of the toner particles, thereby improving storage stability. The content of the polyester in the resin is preferably 90% by mass or more, more preferably 95% by mass or more, even more preferably substantially 100% by mass, and even more preferably 100% by mass, i.e. only the polyester is used. However, other resin besides the polyester may be contained within the range that would not impair the effects of the present invention. The resins besides the polyester include one or more members selected from resins such as styrenic resins which are homopolymers or copolymers containing styrene or styrene substitutes, such as polystyrenes, styrene-propylene copolymers, styrene-butadiene copolymers, styrene-vinyl chloride copolymers, styrene-vinyl acetate copolymers, styrene-maleic acid copolymers, styrene-acrylate ester copolymers, and styrene-methacrylate ester copolymers, epoxy-based resins, rosin-modified maleic acid resins, polyethylene-based resins, polypropylene-based resins, polyurethane-based resins, silicone-based resins, phenolic resins, and aliphatic or alicyclic hydrocarbon resins.

In the present invention, it is preferable that the polyester is obtained by polycondensing an alcohol component containing a dihydric or higher polyhydric alcohol and a carboxylic acid component containing a dicarboxylic or higher polycarboxylic acid compound.

The dihydric alcohol includes, for example, aliphatic diols having 2 or more carbon atoms and 20 or less carbon atoms, and preferably having 2 or more carbon atoms and 15 or less carbon atoms; an alkylene oxide adduct of bisphenol A represented by the formula (I):

(I)

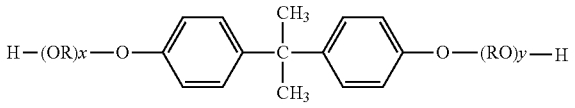

wherein RO and OR are an oxyalkylene group, wherein R is an ethylene group and/or a propylene group; and each of x and y is a positive number showing a number of moles of alkylene oxide added, wherein an average value of the sum of x and y is preferably 1 or more and 16 or less, more preferably 1 or more and 8 or less, and even more preferably 1.5 or more and 4 or less; and the like.

Specific examples of the diol having 2 or more carbon atoms and 20 or less carbon atoms include ethylene glycol, 1,2-propanediol, 1,3-propanediol, 1,4-butanediol, 1,6-hexanediol, bisphenol A, hydrogenated bisphenol A, and the like.

From the viewpoint of improving pulverizability of the toner, thereby obtaining a liquid developer having a smaller particle size, from the viewpoint of improving low-temperature fusing ability of the toner, and from the viewpoint of improving dispersion stability of the toner particles, thereby improving storage stability, the alcohol component is preferably 1,2-propanediol and an alkylene oxide adduct of bisphenol A represented by the formula (I), and especially from the viewpoint of storage stability, 1,2-propanediol is more preferred. In addition, the alkylene oxide adduct of bisphenol A represented by the formula (I) is more preferred, from the viewpoint of pulverizability. The content of 1,2-propanediol or the alkylene oxide adduct of bisphenol A represented by the formula (I) in the alcohol component is preferably 50% by mol or more, more preferably 70% by mol or more, even more preferably 90% by mol or more, even more preferably substantially 100% by mol, and even more preferably 100% by mol. When 1,2-propanediol and the alkylene oxide adduct of bisphenol A represented by the formula (I) are used together, it is preferable that a total content of both is within the above range.

The trihydric or higher polyhydric alcohol includes trihydric or higher polyhydric alcohols having 3 or more carbon atoms and 20 or less carbon atoms, and preferably having 3 or more carbon atoms and 10 or less carbon atoms. Specific examples include sorbitol, 1,4-sorbitan, pentaerythritol, glycerol, trimethylolpropane, and the like.

The dicarboxylic acid compound includes, for example, dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms, anhydrides thereof, or derivatives such as alkyl esters of which alkyl has 1 or more carbon atoms and 3 or less carbon atoms, and the like. Specific examples include aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, and succinic acid substituted with an alkyl group having 1 or more carbon atoms and 20 or less carbon atoms or an alkenyl group having 2 or more carbon atoms and 20 or less carbon atoms.

The tricarboxylic or higher polycarboxylic acid compound includes, for example, tricarboxylic or higher polycarboxylic acids having 4 or more carbon atoms and 20 or less carbon atoms, preferably having 6 or more carbon atoms and 20 or less carbon atoms, and more preferably having 9 or more carbon atoms and 10 or less carbon atoms, anhydrides thereof, derivatives thereof such as alkyl esters of which alkyl has 1 or more carbon atoms and 3 or less carbon atoms. Specific examples include 1,2,4-benzenetricarboxylic acid (trimellitic acid), 1,2,4,5-benzenetetracarboxylic acid (pyromellitic acid), or acid anhydrides thereof, and the like.

The carboxylic acid component is preferably terephthalic acid or fumaric acid, and more preferably terephthalic acid, from the viewpoint of improving low-temperature fusing ability of the toner, and from the viewpoint of improving dispersion stability of the toner particles, thereby improving storage stability. The content of the terephthalic acid in the carboxylic acid component is preferably 40% by mol or more, more preferably 50% by mol or more, even more preferably 70% by mol or more, even more preferably 90% by mol or more, even more preferably substantially 100% by mol, and even more preferably 100% by mol.

In addition, the carboxylic acid component preferably contains 1,2,4-benzenetricarboxylic acid (trimellitic acid) or an anhydride thereof, and more preferably contains trimellitic anhydride, from the viewpoint of improving hot offset resistance of the toner, and from the viewpoint of improving pulverizability of the toner particles. The content of trimellitic anhydride in the carboxylic acid component is preferably 0.1% by mol or more, more preferably 1% by mol or more, and even more preferably 2% by mol or more, and preferably 20% by mol or less, more preferably 15% by mol or less, and even more preferably 13% by mol or less.

Here, the alcohol component may contain a monohydric alcohol, and the carboxylic acid component may contain a monocarboxylic acid compound in proper amounts, from the viewpoint of adjusting a molecular weight and a softening point of the polyester.

The equivalent ratio of the carboxylic acid component to the alcohol component in the polyester, i.e. COOH group or groups/OH group or groups, is preferably 0.70 or more, and more preferably 0.75 or more, and preferably 1.10 or less, and more preferably 1.05 or less, from the viewpoint of adjusting a softening point of the polyester.

The polyester can be produced, for example, by polycondensing the alcohol component and the carboxylic acid component in an inert gas atmosphere at a temperature of 130° C. or higher and 250° C. or lower, optionally in the presence of an esterification catalyst, an esterification promoter, a polymerization inhibitor or the like.

The esterification catalyst includes tin compounds such as dibutyltin oxide and tin(II) 2-ethylhexanoate; titanium compounds such as titanium diisopropylate bistriethanolaminate; and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes tert-butyl catechol, and the like. The amount of the polymerization inhibitor used is preferably 0.001 parts by mass or more, and more preferably 0.01 parts by mass or more, and preferably 0.5 parts by mass or less, and more preferably 0.1 part by mass or less, based on 100 parts by mass of a total amount of the alcohol component and the carboxylic acid component.

The softening point of the polyester is preferably 160° C. or lower, more preferably 130° C. or lower, even more preferably 120° C. or lower, and even more preferably 110° C. or lower, from the viewpoint of improving low-temperature fusing ability of the toner. Also, the softening point is preferably 70° C. or higher, and more preferably 75° C. or higher, from the viewpoint of improving dispersion stability of the toner particles, thereby improving storage stability.

The glass transition temperature of the polyester is preferably 80° C. or lower, more preferably 70° C. or lower, and even more preferably 60° C. or lower, from the viewpoint of improving low-temperature fusing ability. Also, the glass transition temperature is preferably 40° C. or higher, and more preferably 45° C. or higher, from the viewpoint of improving dispersion stability of the toner particles, thereby improving storage stability.

The acid value of the polyester is preferably 110 mgKOH/g or less, more preferably 70 mgKOH/g or less, even more preferably 50 mgKOH/g or less, and even more preferably 30 mgKOH/g or less, from the viewpoint of lowering a viscosity of the liquid developer, and from the viewpoint of improving dispersion stability of the toner particles, thereby improving storage stability. Also, the acid value is preferably 3 mgKOH/g or more, 5 mgKOH/g or more, and even more preferably 8 mgKOH/g or more, from the same viewpoint. The acid value of the polyester can be adjusted by a method such as varying an equivalent ratio of the carboxylic acid component to the alcohol component, varying a reaction time during the production of the resin, or varying the content of the tricarboxylic or higher polycarboxylic acid compound.

Here, in the present invention, the polyester may be a modified polyester to an extent that the properties thereof are not substantially impaired. The modified polyester includes, for example, a polyester grafted or blocked with a phenol, a urethane, an epoxy or the like according to a method described in Japanese Patent Laid-Open No. Hei-11-133668, Hei-10-239903, Hei-8-20636, or the like.

[Pigment]

As the pigment, the pigments which are used as colorants for toners can be used. The pigment includes, for example, carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, and the like. In the present invention, the toner particles may be any one of black toners and color toners.

The content of the pigment is preferably 100 parts by mass or less, more preferably 70 parts by mass or less, even more preferably 50 parts by mass or less, and even more preferably 25 parts by mass or less, based on 100 parts by mass of the resin, from the viewpoint of improving pulverizability of the toner, thereby making it possible to form smaller particle sizes, from the viewpoint of improving low-temperature fusing ability, and from the viewpoint of improving dispersion stability of the toner particles, thereby improving storage stability. Also, the content is preferably 5 parts by mass or more, more preferably 10 parts by mass or more, and even more preferably 15 parts by mass or more, based on 100 parts by mass of the resin, from the viewpoint of improving optical density.

In the present invention, as toner raw materials, an additive such as a releasing agent, a charge control agent, a charge control resin, a magnetic particulate, a fluidity improver, an electric conductivity modifier, a reinforcing filler such as a fibrous material, an antioxidant, or a cleanability improver may be further properly used.

[Method for Producing Toner Particles]

The method for obtaining toner particles includes a method including melt-kneading toner raw materials containing a resin and a pigment, and pulverizing the melt-kneaded product obtained to provide toner particles; a method including mixing an aqueous resin dispersion and an aqueous pigment dispersion, thereby unifying the resin particles and the pigment particles; a method including stirring an aqueous resin dispersion and a pigment at high speed; and the like. The method including melt-kneading toner raw materials, and pulverizing the melt-kneaded product obtained is preferred, from the viewpoint of improving developing ability and fusing ability.

First, it is preferable that the toner raw materials containing a resin and a pigment are previously mixed with a mixer such as a Henschel mixer, a Super mixer or a ball-mill, and the mixture is then fed to a kneader, and the Henschel mixer is more preferred, from the viewpoint of improving pigment dispersibility in the resin.

The mixing with a Henschel mixer is carried out by adjusting a peripheral speed of agitation, and an agitation time. The peripheral speed is preferably 10 msec or more and 30 msec or less, from the viewpoint of improving pigment dispersibility. In addition, the agitation time is preferably 1 minute or more and 10 minutes or less, from the viewpoint of improving pigment dispersibility.

Next, the melt-kneading of toner raw materials can be carried out with a known kneader, such as a tightly closed kneader, a single-screw or twin-screw kneader, or a continuous open-roller type kneader. In the method for production of the present invention, an open-roller type kneader is preferred, from the viewpoint of improving pigment dispersibility, and from the viewpoint of improving an yield of the toner particles after pulverization.

The open-roller type kneader refers to a kneader of which melt-kneading unit is an open type, not being tightly closed, and the kneading heat generated during the melt-kneading can be easily dissipated. The open-roller type kneader used in the present invention is provided with a plurality of feeding ports for raw materials and a discharging port for a kneaded mixture along the shaft direction of the roller, and it is preferable that the open-roller type kneader is a continuous open-roller type kneader, from the viewpoint of production efficiency.

It is preferable that the open-roller type kneader comprises at least two kneading rollers having different temperatures.

It is preferable that the setting temperatures of the rollers are such that the set temperature is equal to or lower than a temperature that is 10° C. higher than the softening point of the resin, from the viewpoint of improving miscibility of the toner raw materials.

In addition, it is preferable that the set temperature of the roller at an upstream side is higher than the set temperature of the roller at a downstream side, from the viewpoint of making the adhesiveness of the kneaded product to the roller at an upstream side favorable and strongly kneading at a downstream side.

It is preferable that the rollers have peripheral speeds that are different from each other. In the open roller-type kneader provided with the above two rollers, it is preferable that the heat roller having a higher temperature is a high-rotation roller, and that the cooling roller having a lower temperature is a low-rotation roller, from the viewpoint of improving fusing ability of the liquid developer.

The peripheral speed of the high-rotation roller is preferably 2 m/min or more, and more preferably 5 m/min or more, and preferably 100 m/min or less, and more preferably 75 m/min or less. The peripheral speed of the low-rotation roller is preferably 2 m/min or more, and more preferably 4 m/min or more, and preferably 100 m/min or less, more preferably 60 m/min or less, and even more preferably 50 m/min or less. Also, the ratio of the peripheral speeds of the two rollers, i.e. low-rotation roller/high-rotation roller, is preferably from 1/10 to 9/10, and more preferably from 3/10 to 8/10.

In addition, structures, size, materials and the like of each of the rollers are not particularly limited. The surface of the roller comprises a groove used in kneading, and the shapes of grooves include linear, spiral, wavy, rugged or other forms.

Next, the melt-kneaded product is cooled to an extent that is pulverizable, and the obtained product is subjected to a pulverizing step and optionally a classifying step, whereby the toner particles can be obtained.

The pulverizing step may be carried out in divided multi-stages. For example, the melt-kneaded product may be roughly pulverized to a size of from 1 to 5 mm or so, and the roughly pulverized product may then be further finely pulverized. In addition, in order to improve productivity during the pulverizing step, the melt-kneaded product may be mixed with fine inorganic particles made of hydrophobic silica or the like, and then pulverized.

The pulverizer suitably used in the rough pulverization includes, for example, an atomizer, Rotoplex, and the like, or a hammer-mill or the like may be used. The pulverizer suitably used in the fine pulverization includes a fluidised bed opposed jet mill, an air jet mill, a rotary mechanical mill, and the like.

The classifier usable in the classification step includes an air classifier, a rotor type classifier, a sieve classifier, and the like. Here, the pulverizing step and the classifying step may be repeated as occasion demands.

The toner particles obtained in this step have a volume-median particle size $D_{50}$ of preferably 3 μm or more, and more preferably 4 μm or more, and preferably 15 μm or less, and more preferably 12 μm or less, from the viewpoint of improving productivity of the wet-milling step described later. Here, the volume-median particle size $D_{50}$ means a particle size of which cumulative volume frequency calculated on a volume percentage is 50% counted from the smaller particle sizes.

[Method for Producing Liquid Developer]

The toner particles are dispersed in an insulating liquid in the presence of a dispersant to provide a liquid developer. It is preferable that a liquid developer is obtained by dispersing toner particles in an insulating liquid, and thereafter subjecting the toner particles to wet-milling, from the viewpoint of making particle sizes of toner particles smaller in a liquid developer, and from the viewpoint of lowering a viscosity of the liquid developer.

[Insulating Liquid]

The insulating liquid in the liquid developer of the present invention is an insulating liquid having a very low volatility. The insulating liquid means a liquid through which electricity is less likely to flow, and in the present invention, the conductivity of the insulating liquid is preferably $1.0\times10^{-11}$ S/m or less, and more preferably $5.0\times10^{-12}$ S/m or less, and preferably $1.0\times10^{-13}$ S/m or more. In addition, it is preferable that the insulating liquid has a dielectric constant of 3.5 or less.

The evaporation rate of the insulating liquid is less than 0.26% by mass, preferably 0.25% by mass or less, more preferably 0.24% by mass or less, even more preferably 0.23% by mass or less, even more preferably 0.20% by mass or less, even more preferably 0.15% by mass or less, even more preferably 0.10% by mass or less, and even more preferably 0% by mass, from the viewpoint of preventing the corona charger contamination. Here, the evaporation rate as referred to herein is a proportion of the mass evaporated, after holding at 40° C. for 30 minutes, based on the mass before holding. When two or more kinds of insulating liquids are used in combination, it is preferred that a combined insulating liquid mixture has an evaporation rate within the above range.

The insulating liquid in the liquid developer of the present invention is preferably an insulating liquid having a small difference between an initial boiling point and a dry point. The difference between the initial boiling point and the dry point of the insulating liquid is preferably 30° C. or less, more preferably 25° C. or less, even more preferably 20° C. or less, even more preferably 18° C. or less, and even more preferably 16° C. or less, from the viewpoint of low-temperature fusing ability, and the difference is preferably 0° C. or more, more preferably 3° C. or more, and even more preferably 5° C. or more, from the viewpoint of availability.

The initial boiling point of the insulating liquid is preferably 250° C. or higher, more preferably 260° C. or higher, even more preferably 270° C. or higher, and even more preferably 280° C. or higher, and preferably 320° C. or lower, more preferably 310° C. or lower, even more preferably 305° C. or lower, and even more preferably 300° C. or lower, from the viewpoint of even more improving low-temperature fusing ability of the toner, from the viewpoint of even more improving dispersion stability of the toner particles, thereby improving storage stability, from the viewpoint of even more improving pulverizability of the toner during wet-milling, thereby obtaining a liquid developer having a smaller particle size, and from the viewpoint of controlling the generation of steam from a dispersion medium.

The dry point of the insulating liquid is preferably 250° C. or higher, more preferably 280° C. or higher, even more preferably 290° C. or higher, and even more preferably 300° C. or higher, and preferably 350° C. or lower, more preferably 340° C. or lower, even more preferably 330° C. or lower, even more preferably 320° C. or lower, even more preferably 315° C. or lower, from the viewpoint of even more improving low-temperature fusing ability of the liquid developer, from the viewpoint of even more improving dispersion stability of the toner particles, thereby improving storage stability, from the viewpoint of even more improving pulverizability of the toner during wet-milling, thereby obtaining a liquid developer having a smaller particle size, and from the viewpoint of controlling the generation of steam of a dispersion medium.

The insulating liquid in the liquid developer of the present invention is preferably an insulating liquid containing a naphthene hydrocarbon.

The naphthene hydrocarbon refers to a hydrocarbon containing at least one saturated ring (naphthene ring) in one molecule, and the hydrocarbon has a high polarity as compared to a chained saturated hydrocarbon (paraffin), and has a high affinity with the polyester. For this reason, it is considered that the toner particles are more likely to be plasticized or swollen even at a lower temperature upon fusing by including a naphthene hydrocarbon, thereby improving low-temperature fusing ability. Especially since an insulating liquid that contains a naphthene hydrocarbon and has a low volatility is used, it is considered that the dispersion stability is maintained without exceedingly progressing the plasticization of the toner particles. Further, in the wet-milling step of the present invention, it is considered that the toner particles are appropriately plasticized, so that pulverizability of the toner is improved, thereby making it more likely to obtain a liquid developer having a smaller particle size.

As specific examples of the naphthene hydrocarbons, naphthenes such as cyclopentane ($C_5H_{10}$, one five-membered ring) and cyclohexane ($C_6H_{12}$, one six-membered ring) have been known. Among the petroleum manufactured products, there are some in which plural naphthene rings are bonded, or further several paraffin side chains are included, and the like, and the naphthene hydrocarbons also include Fichtelite ($C_{19}H_{34}$, condensation of three of 6-membered rings) Oleanane ($C_{30}H_{52}$, condensation of five of 6-membered rings), and the like.

The content of the naphthene hydrocarbon in the insulating liquid is preferably 5% by mass or more, more preferably 10% by mass or more, even more preferably 20% by mass or more, even more preferably 25% by mass or more, even more preferably 30% by mass or more, even more preferably 35% by mass or more, even more preferably 40% by mass or more, and even more preferably 45% by mass or more, from the viewpoint of improving low-temperature fusing ability of the toner, and from the viewpoint of controlling the generation of steam of a dispersion medium. In addition, the content is preferably 80% by mass or less, more preferably 70% by mass or less, even more preferably 60% by mass or less, even more preferably 55% by mass or less, and even more preferably 50% by mass or less, from the viewpoint of improving dispersion stability of the toner particles in the liquid developer, thereby improving storage stability, and from the viewpoint of availability.

Commercially available products of the insulating liquid in which an evaporation rate after holding at 40° C. for 30 minutes is less than 0.26% by mass, a difference between an initial boiling point and a dry point is 30° C. or less, and a naphthene hydrocarbon is contained in an amount of 20% by mass or more include "AF Solvent No. 5," "AF Solvent No. 6" hereinabove both manufactured by JX Nippon Oil & Energy Corporation, and the like. These commercially available products can be used alone or in a combination of two or more kinds.

Specific examples of the insulating liquid other than the naphthene hydrocarbon include, for example, aliphatic hydrocarbons, alicyclic hydrocarbons, aromatic hydrocarbons, halogenated hydrocarbons, polysiloxanes, vegetable oils, and the like. Among them, aliphatic hydrocarbons such as liquid paraffin and isoparaffin are preferred, from the viewpoint of lowering the viscosity of the liquid developer, and from the viewpoint of odor, harmlessness, and costs.

Commercially available products of the aliphatic hydrocarbon include Isopar M manufactured by Exxon Mobile Corporation; ShellSol™, manufactured by Shell Chemicals Japan Ltd.; IP Solvent 2028 and IP Solvent 2835, hereinabove both manufactured by Idemitsu Kosan Co., Ltd.; Isosol 400 manufactured by JX Nippon Oil & Energy Corporation, and the like.

The viscosity of the insulating liquid at 25° C. is preferably 1.0 mPa·s or more, more preferably 1.2 mPa·s or more, and even more preferably 1.3 mPa·s or more, from the viewpoint of improving dispersion stability of the toner particles, thereby even more improving storage stability, and from the viewpoint of even more improving pulverizability of the toner particles during wet-milling, thereby obtaining a liquid developer having a smaller particle size. Also, the viscosity is preferably 30 mPa·s or less, more preferably 10 mPa·s or less, and even more preferably 5 mPa·s or less, from the viewpoint of even more improving low-temperature fusing ability, and from the viewpoint of improving pulverizability of the toner particles during wet-milling, thereby obtaining a liquid developer having a smaller particle size. When the insulating liquids are used in combination of two or more kinds, it is preferable that the viscosity of a mixture is within the above range.

The blending amount of the toner particles, based on 100 parts by mass of the insulating liquid, is preferably 10 parts by mass or more, more preferably 20 parts by mass or more, even more preferably 30 parts by mass or more, even more preferably 40 parts by mass or more, and even more preferably 50 parts by mass or more, from the viewpoint of high-speed printing ability, and the blending amount is preferably 100 parts by mass or less, more preferably 80 parts by mass or less, even more preferably 70 parts by mass or less, and even more preferably 60 parts by mass or less, from the viewpoint of improving dispersion stability.

In addition, the present invention relates to use of an insulating liquid having an evaporation rate after holding at 40° C. for 30 minutes of less than 0.26% by mass as a medium for a liquid developer. A preferred range of the evaporation rate is as mentioned above. The evaporation rate of the insulating liquid is less than 0.26% by mass, preferably 0.25% by mass or less, more preferably 0.24% by mass or less, even more preferably 0.20% by mass or less, even more preferably 0.15% by mass or less, even more preferably 0.10% by mass or less, and even more preferably 0% by mass, from the viewpoint of preventing the corona charger contamination.

[Dispersant]

The liquid developer of the present invention contains a dispersant, from the viewpoint of improving dispersion stability of the toner particles, thereby improving storage stability, and from the viewpoint of improving pulverizability of the toner during wet-milling, thereby obtaining a liquid developer having a smaller particle size. The dispersant is used for stably dispersing the toner particles in an insulating liquid. It is preferable that the liquid developer of the present invention contains a basic dispersant having a basic adsorbing group, from the viewpoint of improving adsorbability to the resin, particularly the polyester. It is preferable that the basic adsorbing group is at least one nitrogen-containing group selected from the group consisting of amino groups (—$NH_2$, —NHR, —NHRR'), an imino group (═NH), an amide group (—C(═O)—NRR'), an imide group (—$N(COR)_2$), a nitro group (—$NO_2$), a cyano group (—CN), an azo group (—N═N—), a diazo group (═$N_2$), and an azide group (—$N_3$), from the viewpoint of positive chargeability of the toner. Here, each of R and R' stands for a hydrocarbon group having from 1 to 5 carbon atoms. The amino groups or imino group is preferred, from the viewpoint of adsorbability of the dispersant to the toner particles, and the imino group is more preferred, from the viewpoint of availability. The basic dispersant preferably has plural basic adsorbing groups, and a basic dispersant having an imino group is preferably a condensate of a polyimine and a carboxylic acid.

As the polyimine, a polyalkyleneimine is preferred, from the viewpoint of improving dispersion stability of the toner particles, thereby even more improving storage stability. Specific examples include polyethyleneimine, polypropyleneimine, polybutyleneimine, and the like, and the polyethyleneimine is more preferred, from the viewpoint of improving dispersion stability of the toner particles, thereby improving storage stability. The number of moles of ethyleneimine added is preferably 10 or more, and more preferably 100 or more, and preferably 1,000 or less, and more preferably 500 or less.

On the other hand, the carboxylic acid is preferably a saturated or unsaturated aliphatic carboxylic acid, and more preferably a linear, saturated or unsaturated aliphatic carboxylic acid, having preferably 10 or more carbon atoms and 30 or less carbon atoms, more preferably 12 or more carbon atoms and 24 or less carbon atoms, and even more preferably 16 or more carbon atoms and 22 or less carbon atoms, from the viewpoint of improving dispersion stability of the toner particles, thereby even more improving storage stability. Specific carboxylic acids include linear saturated aliphatic carboxylic acids such as lauric acid, myristic acid, palmitic acid, and stearic acid; linear unsaturated aliphatic carboxylic acids such as oleic acid, linoleic acid, and linolenic acid; and the like.

Also, the carboxylic acid may have a substituent such as a hydroxy group. A hydroxycarboxylic acid having a hydroxy group as a substituent is preferred, from the viewpoint of improving dispersion stability of the toner particles, thereby improving storage stability. The hydroxycarboxylic acid includes mevalonic acid, ricinoleic acid, 12-hydroxystearic acid, and the like. The hydroxycarboxylic acid may be a condensate thereof.

From the above viewpoint, the carboxylic acid is preferably a hydroxyaliphatic carboxylic acid having preferably 10 or more carbon atoms and 30 or less carbon atoms, more preferably 12 or more carbon atoms and 24 or less carbon atoms, and even more preferably 16 or more carbon atoms and 22 or less carbon atoms, or a condensate thereof, and more preferably 12-hydroxystearic acid or a condensate thereof.

Specific examples of the condensate include SOLSPARSE 11200 and SOLSPARSE 13940, hereinabove both manufactured by Lubrizol Corporation, and the like.

The weight-average molecular weight of the condensate is preferably 2,000 or more, more preferably 4,000 or more, and even more preferably 8,000 or more, from the viewpoint of improving dispersion stability of the toner particles, thereby improving storage stability. Also, the weight-average molecular weight is preferably 50,000 or less, more preferably 40,000 or less, even more preferably 30,000 or less, and even more preferably 20,000 or less, from the viewpoint of pulverizability of the toner.

The amount of the dispersant, based on 100 parts by mass of the toner particles, is preferably 0.5 parts by mass or more, more preferably 1 part by mass or more, and even more preferably 2 parts by mass or more, from the viewpoint of controlling the aggregation of the toner particles, thereby lowering the viscosity of the liquid developer. Also, the amount is preferably 20 parts by mass or less, more preferably 15 parts by mass or less, even more preferably 10 parts by mass or less, and even more preferably 5 parts by mass or less, from the viewpoint of improving developing ability and fusing ability.

In addition, the content ratio of the condensate in the dispersant is preferably 50% by mass or more, more preferably 70% by mass or more, even more preferably 90% by mass or more, even more preferably substantially 100% by mass, and even more preferably 100% by mass, from the viewpoint of controlling the aggregation of the toner particles, thereby lowering the viscosity of the liquid developer, and from the viewpoint of improving pulverizability of the toner during wet-milling, thereby obtaining a liquid developer having a smaller particle size.

The dispersant other than the compound having a polyimine such as a condensate of a polyimine and a carboxylic acid includes copolymers of alkyl methacrylate/amino group-containing methacrylate, copolymers of α-olefin/vinyl pyrrolidone (Antaron V-216), and the like.

It is preferable that a method for mixing toner particles, an insulating liquid, and a dispersant is a method including stirring the components with an agitation mixer, or the like.

The agitation mixer is, but not particularly limited to, preferably high-speed agitation mixers, from the viewpoint of improving productivity and storage stability of the dispersion of toner particles. Specific examples are preferably DESPA manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX manufactured by M Technique Co., Ltd.; KADY Mill manufactured by KADY International, and the like.

The toner particles are previously dispersed by mixing components with a high-speed agitation mixer, whereby a dispersion of toner particles can be obtained, which in turn improves productivity of a liquid developer by the subsequent wet-milling.

The solid content concentration of the dispersion of toner particles is preferably 20% by mass or more, more preferably 30% by mass or more, and even more preferably 33% by mass or more, from the viewpoint of improving optical density. In addition, the solid content concentration is preferably 50% by mass or less, more preferably 45% by mass or less, and even more preferably 40% by mass or less, from the viewpoint of improving dispersion stability of the toner particles, thereby improving storage stability.

[Wet-Milling]

The wet-milling refers to a method of subjecting toner particles dispersed in an insulating liquid to a mechanical milling treatment in the state of dispersion in the insulating liquid.

As the apparatus used, for example, generally used agitation mixers such as anchor blades can be used. The agitation mixers include high-speed agitation mixers such as DESPA manufactured by ASADA IRON WORKS CO., LTD., and T.K. HOMOGENIZING MIXER manufactured by PRIMIX Corporation; pulverizers or kneaders, such as roller mills, beads-mills, kneaders, and extruders; and the like. These apparatuses can also be used in a combination of plural apparatuses.

Among these apparatuses, use of beads-mill is preferred, from the viewpoint of making particle sizes of toner particles smaller, from the viewpoint of improving dispersion stability of the toner particles, thereby improving storage stability, and from the viewpoint of lowering the viscosity of the dispersion thereof.

By controlling particle sizes and filling ratios of media used, peripheral speeds of rotors, residence time, or the like in the beads-mill, toner particles having a desired particle size and a particle size distribution can be obtained.

As mentioned above, it is preferable that the liquid developer of the present invention is produced by a method including:

step 1: melt-kneading a resin containing a polyester and a pigment, and pulverizing a kneaded product, to provide toner particles;

step 2: adding a dispersant to the toner particles obtained in the step 1, and dispersing the toner particles in an insulating liquid to provide a dispersion of toner particles, and step 3: subjecting the dispersion of toner particles obtained in the step 2 to wet-milling, to provide a liquid developer.

The solid content concentration of the liquid developer is preferably 10% by mass or more, more preferably 15% by mass or more, and even more preferably 20% by mass or more, from the viewpoint of improving optical density. Also, the solid content concentration is preferably 50% by mass or less, more preferably 45% by mass or less, and even more preferably 40% by mass or less, from the viewpoint of improving dispersion stability of toner particles, thereby improving storage stability.

The volume-median particle size $D_{50}$ of the toner particles in the liquid developer is preferably 5 μm or less, more preferably 3 μm or less, and even more preferably 2.5 μm or less, from the viewpoint of improving image quality of the liquid developer. Also, the volume median particle size is preferably 0.5 μm or more, more preferably 1.0 μm or more, and even more preferably 1.5 μm or more, from the viewpoint of lowering the viscosity of the liquid developer.

The viscosity of the liquid developer at 25° C. is preferably 50 mPa·s or less, more preferably 40 mPa·s or less, even more preferably 37 mPa·s or less, and even more preferably 35 mPa·s or less, from the viewpoint of improving fusing ability of the liquid developer. Also, the viscosity is preferably 3 mPa·s or more, more preferably 5 mPa·s or more, even more preferably 6 mPa·s or more, and even more preferably 7 mPa·s or more, from the viewpoint of improving dispersion stability of the toner particles, thereby improving storage stability.

With regard to the embodiments described above, the present invention further discloses the following liquid developer and the method for producing the same.

<1> A liquid developer containing toner particles containing a resin containing a polyester and a pigment, wherein the toner particles are dispersed in an insulating liquid in the presence of a dispersant, wherein the above insulating liquid has an evaporation rate after holding at 40° C. for 30 minutes of less than 0.26% by mass.

<2> The liquid developer according to the above <1>, wherein the polyester is obtained by polycondensing an alcohol component containing a dihydric or higher polyhydric alcohol and a carboxylic acid component containing a dicarboxylic or higher polycarboxylic acid compound.

<3> The liquid developer according to the above <2>, wherein the dihydric or higher polyhydric alcohol is one or more members selected from aliphatic diols having 2 or more carbon atoms and 20 or less carbon atoms, and preferably having 2 or more carbon atoms and 15 or less carbon atoms, alkylene oxide adducts of bisphenol A represented by the formula (I), and trihydric or higher polyhydric alcohols having 3 or more carbon atoms and 20 or less carbon atoms, and preferably having 3 or more carbon atoms and 10 or less carbon atoms.

<4> The liquid developer according to the above <2> or <3>, wherein the dicarboxylic or higher polycarboxylic acid compound is one or more members selected from dicarboxylic acids having 3 or more carbon atoms and 30 or less carbon atoms, preferably having 3 or more carbon atoms and 20 or less carbon atoms, and more preferably having 3 or more carbon atoms and 10 or less carbon atoms, tricarboxylic or higher polycarboxylic acids having 4 or more carbon atoms and 20 or less carbon atoms, preferably having 6 or more carbon atoms and 20 or less carbon atoms, and more preferably 9 or more carbon atoms and 10 or less carbon atoms, anhydrides thereof, and alkyl esters of which alkyl has 1 or more carbon atoms and 3 or less carbon atoms, and even more preferably contains 1,2,4-benzenetricarboxylic acid (trimellitic acid), 1,2,4,5-benzenetetracarboxylic acid (pyromellitic acid) or acid anhydrides thereof.

<5> The liquid developer according to any one of the above <2> to <4>, wherein the equivalent ratio of the carboxylic acid component to the alcohol component, i.e.

COOH group or groups/OH group or groups, is 0.70 or more, and preferably 0.75 or more, and 1.10 or less, and preferably 1.05 or less.

<6> The liquid developer according to any one of the above <1> to <5>, wherein the softening point of the polyester is 160° C. or lower, preferably 130° C. or lower, more preferably 120° C. or lower, and even more preferably 110° C. or lower, and 70° C. or higher, and preferably 75° C. or higher.

<7> The liquid developer according to any one of the above <1> to <6>, wherein the glass transition temperature of the polyester is 80° C. or lower, preferably 70° C. or lower, and more preferably 60° C. or lower, and 40° C. or higher, and preferably 45° C. or higher.

<8> The liquid developer according to any one of the above <1> to <7>, wherein the acid value of the polyester is 110 mgKOH/g or less, preferably 70 mgKOH/g or less, more preferably 50 mgKOH/g or less, and even more preferably 30 mgKOH/g or less, and 3 mgKOH/g or more, preferably 5 mgKOH/g or more, and more preferably 8 mgKOH/g or more.

<9> The liquid developer according to any one of the above <1> to <8>, wherein the pigment is one or more members selected from carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, and disazo yellow.

<10> The liquid developer according to any one of the above <1> to <9>, wherein the conductivity of the insulating liquid is $1.0\times10^{-11}$ S/m or less, and preferably $5.0\times10^{-12}$ S/m or less, and $1.0\times10^{-13}$ S/m or more.

<11> The liquid developer according to any one of the above <1> to <10>, wherein the evaporation rate of the insulating liquid after holding at 40° C. for 30 minutes is 0.25% by mass or less, preferably 0.24% by mass or less, more preferably 0.23% by mass or less, even more preferably 0.20% by mass or less, even more preferably 0.15% by mass or less, even more preferably 0.10% by mass or less, and even more preferably 0% by mass.

<12> The liquid developer according to any one of the above <1> to <11>, wherein the difference between the initial boiling point and the dry point of the insulating liquid is 30° C. or less, preferably 25° C. or less, more preferably 20° C. or less, even more preferably 18° C. or less, and even more preferably 16° C. or less, and 0° C. or more, preferably 3° C. or more, and more preferably 5° C. or more.

<13> The liquid developer according to any one of the above <1> to <12>, wherein the initial boiling point of the insulating liquid is 250° C. or higher, preferably 260° C. or higher, more preferably 270° C. or higher, and even more preferably 280° C. or higher, and 320° C. or lower, preferably 310° C. or lower, more preferably 305° C. or lower, and even more preferably 300° C. or lower.

<14> The liquid developer according to any one of the above <1> to <13>, wherein the dry point of the insulating liquid is 250° C. or higher, preferably 280° C. or higher, more preferably 290° C. or higher, and even more preferably 300° C. or higher, and 350° C. or lower, preferably 340° C. or lower, more preferably 330° C. or lower, even more preferably 320° C. or lower, and even more preferably 315° C. or lower.

<15> The liquid developer according to any one of the above <1> to <14>, wherein the insulating liquid contains a naphthene hydrocarbon.

<16> The liquid developer according to the above <15>, wherein the content of the naphthene hydrocarbon in the insulating liquid is 5% by mass or more, preferably 10% by mass or more, more preferably 20% by mass or more, even more preferably 25% by mass or more, even more preferably 30% by mass or more, even more preferably 35% by mass or more, even more preferably 40% by mass or more, and even more preferably 45% by mass or more, and 80% by mass or less, preferably 70% by mass or less, more preferably 60% by mass or less, even more preferably 55% by mass or less, and even more preferably 50% by mass or less.

<17> The liquid developer according to any one of the above <1> to <16>, wherein the viscosity of the insulating liquid at 25° C. is 1.0 mPa·s or more, preferably 1.2 mPa·s or more, and more preferably 1.3 mPa·s or more, and 30 mPa·s or less, preferably 10 mPa·s or less, and more preferably 5 mPa·s or less.

<18> The liquid developer according to any one of the above <1> to <17>, wherein the dispersant contains a basic dispersant including a basic dispersant having a basic adsorbing group, preferably an amino group or an imino group, and more preferably an imino group.

<19> The liquid developer according to the above <18>, wherein the basic dispersant is a compound having a polyimine, and preferably a condensate of a polyimine and a carboxylic acid.

<20> The liquid developer according to the above <19>, wherein the polyimine is a polyethyleneimine, wherein the number of moles of ethyleneimine added is preferably 10 or more, and more preferably 100 or more, and preferably 1,000 or less, and more preferably 500 or less.

<21> The liquid developer according to the above <19> or <20>, wherein the carboxylic acid is a saturated or unsaturated aliphatic carboxylic acid, and preferably a linear, saturated or unsaturated aliphatic carboxylic acid, having the number of carbon atoms of 10 or more, preferably 12 or more, and more preferably 16 or more, and 30 or less, preferably 24 or less, and more preferably 22 or less.

<22> The liquid developer according to any one of the above <19> to <21>, wherein the carboxylic acid is a hydroxyaliphatic carboxylic acid having the number of carbon atoms of 10 or more, preferably 12 or more, and more preferably 16 or more, and 30 or less, preferably 24 or less, and more preferably 22 or less, or a condensate thereof, and preferably 12-hydroxystearic acid or a condensate thereof.

<23> The liquid developer according to any one of the above <1> to <22>, wherein the volume median particle size $D_{50}$ of the toner particles in the liquid developer is 5 μm or less, preferably 3 μm or less, and more preferably 2.5 μm or less, and 0.5 μm or more, preferably 1.0 μm or more, and more preferably 1.5 μm or more.

<24> The liquid developer according to any one of the above <1> to <23>, wherein the viscosity of the liquid developer at 25° C. is 50 mPa·s or less, preferably 40 mPa·s or less, more preferably 37 mPa·s or less, and even more preferably 35 mPa·s or less, and 3 mPa·s or more, preferably 5 mPa·s or more, more preferably 6 mPa·s or more, and even more preferably 7 mPa·s or more.

<25> Use of an insulating liquid having an evaporation rate after holding at 40° C. for 30 minutes of less than 0.26% by mass as a medium for a liquid developer.

<26> The use of an insulating liquid according to the above <25>, wherein the insulating liquid has an evaporation rate after holding at 40° C. for 30 minutes of 0.25% by mass or less, preferably 0.24% by mass or less, more preferably 0.23% by mass or less, even more preferably 0.20% by mass or less, even more preferably 0.15% by mass or less, even more preferably 0.10% by mass or less, and even more preferably 0% by mass.

<27> A method for producing a liquid developer containing toner particles containing a resin containing a polyester and a pigment, wherein the toner particles are dispersed in an insulating liquid in the presence of a dispersant, including:

step 1: melt-kneading a resin containing a polyester and a pigment, and pulverizing a kneaded product obtained, to provide toner particles, step 2: adding a dispersant to the toner particles obtained in the step 1, and dispersing the toner particles in an insulating liquid to provide a dispersion of toner particles, and step 3: subjecting the dispersion of toner particles obtained in the step 2 to wet-milling, to provide a liquid developer, wherein the above insulating liquid has an evaporation rate after holding at 40° C. for 30 minutes of less than 0.26% by mass.

<28> The method for producing a liquid developer according to the above <27>, wherein the step 1 includes previously mixing toner raw materials containing a resin and a pigment with one or more mixers selected from a Henschel mixer, a Super mixer, and a ball-mill, and thereafter feeding the mixture to a kneader to melt-knead.

<29> The method for producing a liquid developer according to the above <27> or <28>, wherein the melt-kneading in the step 1 is carried out with one or more kneaders selected from such as a tightly closed kneader, a single-screw or twin-screw kneader, and a continuous open-roller type kneader, etc.

<30> The method for producing a liquid developer according to any one of the above <27> to <29>, wherein in the step 1 the pulverization of the melt-kneaded product is carried out with one or more pulverizers selected from an atomizer, Rotoplex, a hammer-mill, a fluidised bed opposed jet mill, an air jet mill, and a rotary mechanical mill.

<31> The method for producing a liquid developer according to any one of the above <27> to <30>, wherein the wet-milling in the step 3 is carried out with a high-speed agitation mixer, or one or more pulverizers or kneaders selected from roller mills, beads-mills, kneaders, and extruders.

The present invention will be described hereinbelow more specifically by the Examples, without intending to limit the present invention to these Examples. The physical properties of the resins and the like were measured in accordance with the following methods.

[Softening Point of Resin]

Using a flow tester "CFT-500D," manufactured by Shimadzu Corporation, a 1 g sample is extruded through a nozzle having a diameter of 1 mm and a length of 1 mm with applying a load of 1.96 MPa thereto with a plunger, while heating the sample at a heating rate of 6° C./min. The softening point refers to a temperature at which half of the sample flows out, when plotting a downward movement of the plunger of the flow tester against temperature.

[Glass Transition Temperature of Resin]

Using a differential scanning calorimeter "DSC210," manufactured by Seiko Instruments Inc., a 0.01 to 0.02 g sample is weighed out in an aluminum pan, heated to 200° C., and cooled from that temperature to 0° C. at a cooling rate of 10° C./min. Next, the temperature of the sample is raised at a heating rate of 10° C./min to measure endothermic peaks. A temperature of an intersection of the extension of the baseline of equal to or lower than the highest temperature of endothermic peak and the tangential line showing the maximum inclination between the kick-off of the peak and the top of the peak is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Volume-Median Particle Size of Toner Particles Before Mixing with Insulating Liquid]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Dispersion: EMULGEN 109P, manufactured by Kao Corporation, polyoxyethylene lauryl ether, HLB (Griffin): 13.6, is dissolved in the above electrolytic solution to adjust to a concentration of 5% by mass to provide a dispersion.

Dispersion Conditions: Ten milligrams of a measurement sample is added to 5 mL of the above dispersion, and the mixture is dispersed for 1 minute with an ultrasonic disperser (name of machine: US-1, manufactured by SND Co., Ltd., output: 80 W), and 25 mL of the above electrolytic solution is then added to the dispersion, and further dispersed with the ultrasonic disperser for 1 minute, to prepare a sample dispersion.

Measurement Conditions: The above sample dispersion is added to 100 mL of the above electrolytic solution to adjust to a concentration at which particle sizes of 30,000 particles can be measured in 20 seconds, and the 30,000 particles are measured, and a volume-median particle size $D_{50}$ is obtained from the particle size distribution.

[Conductivity of Insulating Liquid]

A 40 mL glass sample vial "Vial with screw cap, No. 7," manufactured by Maruemu Corporation is charged with 25 g of an insulating liquid. The conductivity is determined by immersing an electrode in a liquid developer, taking 20 measurements for conductivity with a non-aqueous conductivity meter "DT-700," manufactured by Dispersion Technology, Inc., and calculating an average thereof. The smaller the numerical figures, the higher the resistance.

[Viscosity at 25° C. of Insulating Liquid]

A 10-mL glass sample vial with screw cap is charged with 6 to 7 mL of a measurement solution, and a viscosity at 25° C. is measured with a torsional oscillation type viscometer "VISCOMATE VM-10A-L," manufactured by SEKONIC CORPORATION.

[Evaporation Rate of Insulating Liquid at 40° C. for 30 Minutes]

An insulating liquid was accurately weighed in an amount of from 4.0 to 8.0 mg, and an evaporation rate (% by mass) when held at 40° C. for 30 minutes under a nitrogen gas stream (200 mL/min) with a thermal analyzer EXTRA TG/DTA 7200 manufactured by SIT nanotechnology was measured. The smaller the evaporation rate (%), the insulating liquid is less likely to be evaporated.

[Initial Boiling Point and Dry Point of Insulating Liquid]

The initial boiling point and the dry point are measured by a method as prescribed in ASTM D86.

[Content of Naphthene Hydrocarbon in Insulating Liquid]

The content is measured by a method as prescribed in JIS K 2536-2.

[Weight-Average Molecular Weight (Mw) of Condensate of Polyimine and Carboxylic Acid]

The weight-average molecular weight is obtained by measuring a molecular weight distribution in accordance with a gel permeation chromatography (GPC) method.

(1) Preparation of Sample Solution

A dispersant is dissolved in chloroform so as to have a concentration of 0.2 g/100 mL. Next, this solution is filtered with a PTFE-type membrane filter "DISMIC-25JP," manufactured by Toyo Roshi Kaisha, Ltd., having a pore size of 0.20 μm, to remove insoluble components, to provide a sample solution.

(2) Molecular Weight Measurements

Using the following measurement apparatus and analyzing column, a chloroform solution of 100 mmol/L FARMIN DM2098 manufactured by Kao Corporation is allowed to flow through a column as an eluent at a flow rate of 1 mL per minute, the column is stabilized in a thermostat at 40° C., and 100 μl of a sample solution is loaded thereto. The molecular weight of the sample is calculated based on the previously drawn calibration curve. At this time, a calibration curve is drawn from several kinds of monodisperse polystyrenes, manufactured by Tosoh Corporation, A-500 (Mw: $5.0\times10^2$), A-5000 (Mw: $5.97\times10^3$), F-2 (Mw: $1.81\times10^4$), F-10 (Mw: $9.64\times10^4$), and F-40 (Mw: $4.27\times10^5$) as standard samples. The values within the parentheses show molecular weights.

Measurement Apparatus: HLC-8220GPC, manufactured by Tosoh Corporation

Analyzing Column: K-804L, SHOWA DENKO CORPORATION

[Solid Content Concentrations of Dispersion of Toner Particles and Liquid Developer]

Ten parts by mass of a sample is diluted with 90 parts by mass of hexane, and the dilution is spun with a centrifuge "H-201F," manufactured by KOKUSAN Co., Ltd. at a rotational speed of 25,000 r/min for 20 minutes. After allowing the mixture to stand, the supernatant is removed by decantation, the mixture is then diluted with 90 parts by mass of hexane, and the dilution is again centrifuged under the same conditions as above. The supernatant is removed by decantation, and a lower layer is then dried with a vacuum dryer at 0.5 kPa and 40° C. for 8 hours. The solid content concentration is calculated according to the following formula:

$$\text{Solid Content Concentration, \% by Mass} = \frac{\text{Mass of Residues After Drying}}{\text{Mass of Sample, Corresponding to 10 Parts by Mass Portion}} \times 100$$

[Viscosity at 25° C. of Liquid Developer]

A 10-mL glass sample vial with screw cap is charged with 6 to 7 mL of a measurement solution, and a viscosity at 25° C. is measured with a torsional oscillation type viscometer "VISCOMATE VM-10A-L," manufactured by SEKONIC CORPORATION.

[Volume-Median Particle Size $D_{50}$ of Toner Particles in Liquid Developer]

A volume-median particle size $D_{50}$ is determined with a laser diffraction/scattering particle size measurement instrument "Mastersizer 2000," manufactured by Malvern Instruments, Ltd., by charging a cell for measurement with Isopar L, manufactured by Exxon Mobile Corporation, isoparaffin, viscosity at 25° C. of 1 mPa·s, under conditions that a particle refractive index is 1.58, imaginary part being 0.1, and a dispersion medium refractive index is 1.42, at a concentration that gives a scattering intensity of from 5 to 15%.

PRODUCTION EXAMPLE 1 of RESIN

A 10-L four-neck flask equipped with a nitrogen inlet tube, a dehydration tube equipped with a fractional distillation tube through which hot water at 98° C. was allowed to flow, a stirrer, and a thermocouple was charged with raw material monomers and an esterification catalyst as listed in Table 1. The contents were heated to 180° C. and then heated to 210° C. over 5 hours, the mixture was reacted until a reaction percentage reached 90%, the reaction mixture was further reacted at 8.3 kPa, and the reaction was terminated at a point where a softening point reached 87° C., to provide a polyester a resin A. The physical properties of the resin A are shown in Table 1. Here, the reaction percentage as used herein refers to a value calculated by:

[amount of generated water in reaction (mol)/theoretical amount of generated water (mol)]×100.

PRODUCTION EXAMPLE 2 of RESIN

A 10-L four-neck flask equipped with a nitrogen inlet tube, a dehydration tube, a stirrer, and a thermocouple was charged with raw material monomers and an esterification catalyst as listed in Table 1. The mixture was reacted at 235° C., the reaction mixture was reacted until a reaction percentage reached 90%, the reaction mixture was further reacted at 8.3 kPa, and the reaction was terminated at a point when an intended softening point was reached, to provide a polyester a resin B having physical properties as shown in Table 1. Here, the reaction percentage as used herein refers to a value calculated by:

[amount of generated water in reaction (mol)/theoretical amount of generated water (mol)]×100.

PRODUCTION EXAMPLE 3 of RESIN

A 10-L four-neck flask equipped with a nitrogen inlet tube, a dehydration tube, a stirrer, and a thermocouple was charged with raw material monomers and an esterification catalyst as listed in Table 1. The mixture was reacted at 235° C., the reaction mixture was reacted until a reaction percentage reached 90%, the reaction mixture was further reacted at 8.3 kPa, and the reaction was terminated at a point when an intended softening point was reached, to provide a polyester a resin C having physical properties as shown in Table 1. Here, the reaction percentage as used herein refers to a value calculated by:

[amount of generated water in reaction (mol)/theoretical amount of generated water (mol)]×100.

PRODUCTION EXAMPLE 4 of RESIN

A 10-L four-neck flask equipped with a nitrogen inlet tube, a dehydration tube, a stirrer, and a thermocouple was charged with raw material monomers and an esterification catalyst as listed in Table 1, other than trimellitic anhydride, fumaric acid, and a polymerization inhibitor. The mixture was reacted in a nitrogen atmosphere at 235° C. for 8 hours, the reaction mixture was then reacted at 8.3 kPa for 1 hour. Thereafter, the reaction mixture was cooled to 210° C., and trimellitic anhydride, fumaric acid, and the polymerization inhibitor were supplied thereto, and the reaction mixture was reacted at an ambient pressure for 1 hour, and then reacted at 8.3 kPa until an intended softening point was reached, to provide each of polyesters resins D and E having physical properties shown in Table 1.

TABLE 1

| | | Resin A | Resin B | Resin C | Resin D | Resin E |
|---|---|---|---|---|---|---|
| Raw Material Monomers | 1,2-Propanediol | 3,640 g (100) | — | — | — | — |
| | BPA-PO | — | 4,473 g (60) | 4,313 g (60) | 7,136 g (100) | 7,037 g (100) |
| | BPA-EO | — | 2,769 g (40) | 2,670 g (40) | — | — |
| | Terephthalic Acid | 6,360 g (80) | 2,858 g (78) | 2,898 g (85) | 1,455 g (43) | 1,335 g (40) |
| | Fumaric Acid | — | — | — | 1,017 g (43) | 933 g (40) |
| | Trimellitic Anhydride | — | — | 118 g (3) | 392 g (10) | 695 g (18) |
| Esterification Catalyst | Dibutyltin Oxide | 50 g | 50 g | 50 g | 50 g | 50 g |
| Polymerization Inhibitor | t-Butyl Catechol | — | — | — | 5 g | 5 g |
| Physical Properties of Resin | Softening Point, ° C. | 87 | 80 | 101 | 103 | 105 |
| | Glass Transition Temperature, ° C. | 47 | 50 | 61 | 53 | 55 |
| | Acid Value, mgKOH/g | 10 | 12 | 12 | 35 | 60 |

Note)
The numerical figures inside the parentheses are expressed by a molar ratio when a total amount of alcohol component is defined as 100 mol.
BPA-PO: Polyoxypropylene(2.2)-2,2-bis(4-hydroxyphenyl)propane
BPA-EO: Polyoxyethylene(2.0)-2,2-bis(4-hydroxyphenyl)propane The details of the insulating liquids used in Examples and Comparative Examples are listed in Tables 2 and 3.

TABLE 2

| Trade Name | Manufacturer | Chemical Name | Conductivity, S/m | Viscosity at 25° C., mPas |
|---|---|---|---|---|
| AF Solvent No. 5 | JX Nippon Oil & Energy Corporation | Naphthene Hydrocarbon | $8.15 \times 10^{-13}$ | 4.0 |
| AF Solvent No. 6 | JX Nippon Oil & Energy Corporation | Naphthene Hydrocarbon | $8.29 \times 10^{-13}$ | 5.0 |
| Exxsol D130 | Exxon Mobile Corporation | Naphthene Hydrocarbon | $1.04 \times 10^{-12}$ | 4.6 |
| Exxsol D110 | Exxon Mobile Corporation | Naphthene Hydrocarbon | $1.69 \times 10^{-12}$ | 2.5 |
| AF Solvent No. 7 | JX Nippon Oil & Energy Corporation | Naphthene Hydrocarbon | $5.44 \times 10^{-13}$ | 3.2 |
| Naphtesol 160 | JX Nippon Oil & Energy Corporation | Naphthene Hydrocarbon | $1.16 \times 10^{-12}$ | 0.8 |
| Naphtesol 200 | JX Nippon Oil & Energy Corporation | Naphthene Hydrocarbon | $1.33 \times 10^{-12}$ | 1.3 |
| Naphtesol 220 | JX Nippon Oil & Energy Corporation | Naphthene Hydrocarbon | $1.26 \times 10^{-12}$ | 1.7 |
| Exxsol D80 | Exxon Mobile Corporation | Naphthene Hydrocarbon | $1.40 \times 10^{-12}$ | 1.4 |

EXAMPLES 1 to 3 and COMPARATIVE EXAMPLES 1 to 7

Eighty-five parts by mass of a resin A and 15 parts by mass of a pigment "ECB-301" manufactured by DAINICHISEIKA COLOR & CHEMICALS MFG. CO., LTD., Phthalocyanine Blue 15:3, were previously mixed with a 20-L Henschel mixer while stirring for 3 minutes at a rotational speed of 1,500 r/min (peripheral speed 21.6 m/sec), and the mixture was then melt-kneaded under the conditions given below.

[Melt-Kneading Conditions]

A continuous twin open-roller type kneader "Kneadex," manufactured by NIPPON COKE & ENGINEERING CO., LTD. having an outer diameter of roller of 14 cm and an effective length of roller of 55 cm was used. The operating conditions of the continuous twin open-roller type kneader were a peripheral speed of a high-rotation roller (front roller) of 75 r/min (32.4 m/min), a peripheral speed of a low-rotation roller (back roller) of 35 r/min (15.0 m/min), and a gap between the rollers at an end of the kneaded product-feeding port side of 0.1 mm. The temperatures of the heating medium and the cooling medium inside the rollers were as follows. The high-rotation roller had a temperature at the raw material supplying side of 90° C., and a temperature at the kneaded product-discharging side of 85° C., and the low-rotation roller had a temperature at the raw material supplying side of 35° C., and a temperature at the kneaded product-discharging side of 35° C. In addition, the feeding rate of the raw material mixture to the kneader was 10 kg/h, and the average residence time in the kneader was about 3 minutes.

The kneaded product obtained above was roll-cooled with a cooling roller, and the cooled product was then roughly pulverized with a hammer-mill to a size of 1 mm or so. The roughly pulverized product obtained was finely pulverized and classified with an air jet mill "IDS," manufactured by Nippon Pneumatic Mfg. Co., Ltd., to provide toner particles having a volume-median particle size $D_{50}$ of 10 μm.

A 2-L polyethylene vessel was charged with the toner particles, an insulating liquid, and a dispersant in proportions as listed in Table 3, and the contents were stirred with "T.K. ROBOMIX," manufactured by PRIMIX Corporation, under ice-cooling at a rotational speed of 7,000 r/min for 30 minutes, to provide a dispersion of toner particles having a solid content concentration of 35% by mass.

Next, the dispersion of toner particles obtained was subjected to wet-milling for 4 hours with 6 vessels-type sand grinder "TSG-6," manufactured by AIMEX CO., LTD., at a rotational speed of 1,300 r/min (peripheral speed 4.8 m/sec) using zirconia beads having a diameter of 0.8 mm at a volume filling ratio of 60% by volume. The beads were removed by filtration, and the filtrate was diluted with the insulating liquid to a solid content concentration of 25% by mass, to provide a liquid developer having physical properties as shown in Table 4.

EXAMPLES 4 to 7

The same procedures as in Example 1 were carried out except that 85 parts by mass of the resin as listed in Table 3 was used in place of the resin A, to provide each of liquid developers having physical properties as shown in Table 4 or 5.

EXAMPLE 8

The same procedures as in Example 4 were carried out except that SOLSPARSE 11200 was used in place of SOLSPARSE 13940 as a dispersant, to provide a liquid developer having physical properties as shown in Table 5.

TEST EXAMPLE 1—LOW-TEMPERATURE FUSING ABILITY

A liquid developer was dropped on "POD Gloss Coated Paper" manufactured by Oji Paper Co., Ltd., and produced a thin film with a wire bar, so that the mass on a dry basis was 1.2 g/m$^2$. Thereafter, the produced thin film was held in a thermostat at 80° C. for 10 seconds.

Next, a fusing treatment was carried out at a fusing roller temperature of 80° C. and a fusing speed of 280 mm/sec, with a fuser taken out of "OKI MICROLINE 3010," manufactured by Oki Data Corporation.

Thereafter, the same fusing treatment as mentioned above was carried out at each temperature while raising the fusing roller temperature up to 160° C. with an increment of 10° C., to provide fused images at each temperature.

The fused images obtained were adhered to a mending tape "Scotch Mending Tape 810," manufactured by 3M, width of 18 mm, the tape was pressed with a roller so as to apply a load of 500 g thereto, and the tape was then removed. The optical densities before and after tape removal were measured with a colorimeter "GretagMacbeth Spectroeye," manufactured by Gretag. The fused image-printed portions were measured at 3 points each, and an average thereof was calculated as an optical density. A fusing ratio (%) was calculated from a value obtained by [optical density after removal]/[optical density before removal]×100, to evaluate low-temperature fusing ability where a temperature at which a fusing ratio reaches 90% or more is defined as a lowest fusing temperature. The results are shown in Tables 4 and 5. The smaller the numerical value, the more excellent the low-temperature fusing ability.

TEST EXAMPLE 2—HOT OFFSET RESISTANCE

Each of the liquid developers of Examples 5 to 8 was evaluated for hot offset resistance where a temperature at which a fusing ratio is 90% or more and an upper limit of the temperature at which hot offset is not generated in the fusing test of Test Example 1 is defined as a highest fusing temperature. The results are shown in Table 5. The larger the numerical value, the higher the hot offset resistance.

TEST EXAMPLE 3—CONTROL OF CORONA CHARGER CONTAMINATION

Using a commercially available printer for liquid developers, a surface potential of a photoconductor was set at 480 V under the environment conditions of 23° C. and 50% RH. The printer was operated only with an insulating liquid for 3 hours, changes in the surface potentials of the photoconductor were measured, and the control of corona charger contamination was evaluated in accordance with the following evaluation criteria. The results are shown in Tables 4 and 5. Here, in a case where a surface potential changed by ±15 V or more, the time was also recorded.

[Evaluation Criteria]

A: no corona charger contamination being found (a change in surface potentials of the photoconductor of less than ±10 V);

B: corona charger contamination being slightly found (a change in surface potentials of the photoconductor of less than ±15 V); and C: corona charger contamination being evidently found (a change in surface potentials of the photoconductor of ±15 V or more).

TEST EXAMPLE 4—PULVERIZABILITY

The pulverizability was evaluated from the measurement of a volume-median particle size $D_{50}$ of the toner particles in the liquid developer after being wet-milled for 4 hours, in accordance with the following evaluation criteria. The results are shown in Tables 4 and 5. The smaller the numerical value, the more excellent the pulverizability.

[Evaluation Criteria]

A: a volume-median particle size of less than 2.0 μm;

B: a volume-median particle size of 2.0 μm or more and less than 2.5 μm;

C: a volume-median particle size of 2.5 μm or more and less than 3.0 μm; and

D: a volume-median particle size of 3.0 μm or more.

TEST EXAMPLE 5—STORAGE STABILITY

A 20-mL glass sample vial "Vial with screw cap, No. 5," manufactured by Maruemu Corporation, was charged with 10 g of a liquid developer, and thereafter stored in a thermostat at 40° C. for 12 hours. Volume-median particle sizes $D_{50}$ of the toner particles before and after the storage were measured, and storage stability was evaluated from a value of a difference therebetween [($D_{50}$ After Storage)−($D_{50}$ Before Storage)]. The results are shown in Tables 4 and 5. The more the numerical value approximates 0, the more excellent the storage stability.

TABLE 3

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Resin | Resin A | 105 g | 105 g | 105 g | — | — | — | — | — |
| | Resin B | — | — | — | 105 g | — | — | — | 105 g |
| | Resin C | — | — | — | — | 105 g | — | — | — |
| | Resin D | — | — | — | — | — | 105 g | — | — |
| | Resin E | — | — | — | — | — | — | 105 g | — |

TABLE 3-continued

| | | | | | | | | | |
|---|---|---|---|---|---|---|---|---|---|
| Dispersant | SOLSPARSE 13940 | 7.9 g | 7.9 g | — | 7.9 g | — | — | — | — |
| | SOLSPARSE 11200 | — | — | 7.9 g | — | 7.9 g | 7.9 g | 7.9 g | 7.9 g |
| Insulating Liquid | AF Solvent No. 5 | 187.1 g | — | 187.1 g | 187.1 g | 187.1 g | 187.1 g | 187.1 g | 187.1 g |
| | AF Solvent No. 6 | — | 187.1 g | — | — | — | — | — | — |
| | Exxsol D130 | — | — | — | — | — | — | — | — |
| | Exxsol D110 | — | — | — | — | — | — | — | — |
| | AF Solvent No. 7 | — | — | — | — | — | — | — | — |
| | Naphtesol 160 | — | — | — | — | — | — | — | — |
| | Naphtesol 200 | — | — | — | — | — | — | — | — |
| | Naphtesol 220 | — | — | — | — | — | — | — | — |
| | Exxsol D80 | — | — | — | — | — | — | — | — |
| Physical Properties of Insulating Liquid | Content of Naphthene Hydrocarbon, % by Mass | 50 | 45 | 50 | 50 | 50 | 50 | 50 | 50 |
| | Evaporation Rate, % by Mass | 0.23 | 0.10 | 0.23 | 0.23 | 0.23 | 0.23 | 0.23 | 0.23 |
| | Initial Boiling Point, ° C. | 284 | 298 | 284 | 284 | 284 | 284 | 284 | 284 |
| | Dry Point, ° C. | 300 | 314 | 300 | 300 | 300 | 300 | 300 | 300 |
| | Difference Between Initial Boiling Point and Dry Point, ° C. | 16 | 16 | 16 | 16 | 16 | 16 | 16 | 16 |

| | | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|
| Resin | Resin A | 105 g | 105 g | 105 g | 105 g | 105 g | 105 g | 105 g |
| | Resin B | — | — | — | — | — | — | — |
| | Resin C | — | — | — | — | — | — | — |
| | Resin D | — | — | — | — | — | — | — |
| | Resin E | — | — | — | — | — | — | — |
| Dispersant | SOLSPARSE 13940 | 7.9 g | 7.9 g | 7.9 g | 7.9 g | 7.9 g | 7.9 g | 7.9 g |
| | SOLSPARSE 11200 | — | — | — | — | — | — | — |
| Insulating Liquid | AF Solvent No. 5 | — | — | — | — | — | — | — |
| | AF Solvent No. 6 | — | — | — | — | — | — | — |
| | Exxsol D130 | 187.1 g | — | — | — | — | — | — |
| | Exxsol D110 | — | 187.1 g | — | — | — | — | — |
| | AF Solvent No. 7 | — | — | 187.1 g | — | — | — | — |
| | Naphtesol 160 | — | — | — | 187.1 g | — | — | — |
| | Naphtesol 200 | — | — | — | — | 187.1 g | — | — |
| | Naphtesol 220 | — | — | — | — | — | 187.1 g | — |
| | Exxsol D80 | — | — | — | — | — | — | 187.1 g |
| Physical Properties of Insulating Liquid | Content of Naphthene Hydrocarbon, % by Mass | 47 | 55 | 65 | 58 | 59 | 52 | 48 |
| | Evaporation Rate, % by Mass | 0.26 | 0.80 | 0.65 | 60.8 | 15.2 | 5.0 | 11.6 |
| | Initial Boiling Point, ° C. | 279 | 248 | 260 | 157 | 201 | 221 | 205 |
| | Dry Point, ° C. | 313 | 265 | 278 | 179 | 217 | 240 | 240 |
| | Difference Between Initial Boiling Point and Dry Point, ° C. | 34 | 17 | 18 | 22 | 16 | 19 | 35 |

Note:

SOLSPARSE 13940: manufactured by Lubrizol Corporation, a condensate of a polyimine (polyethyleneimine, number of moles added: 230) and a carboxylic acid (a condensate of 12-hydroxystearic acid, average degree of polymerization: 3.5), effective content: 40% by mass, weight-average molecular weight: 24,200, polyimine/carboxylic acid (mass ratio) = 27/73

SOLSPARSE 11200: manufactured by Lubrizol Corporation, a condensate of a polyimine (polyethyleneimine) and a carboxylic acid (a condensate of 12-hydroxystearic acid, average degree of polymerization: 7.0), effective content: 50% by mass, weight-average molecular weight: 10,400, polyimine/carboxylic acid (mass ratio) = 7/93

TABLE 4

| | | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|---|---|
| Physical Properties of Liquid Developer | Viscosity of Liquid Developer, mPa · s | 25 | 33 | 15 | 18 | 29 | 17 | 20 | 19 | 24 | 33 | 24 |
| | $D_{50}$ of Toner Particles, μm | 2.5 | 2.8 | 1.9 | 2.3 | 2.5 | 2.0 | 2.2 | 2.9 | 2.1 | 2.4 | 2.2 |
| Evaluation of Liquid Developer | Lowest Fusing Temperature, ° C. | 80 | 80 | 80 | 80 | 120 | 80 | 80 | 80 | 80 | 80 | 80 |
| | Control of Corona Charger Contamination | A | A | A | A | B | C | C | C | C | C | C |
| | Generation Time of Corona Charger Contamination, minute | — | — | — | — | — | 20 | 32 | 1 | 2 | 3 | 10 |
| | Pulverizability | C | C | A | B | C | B | B | C | B | B | B |
| | $D_{50}$ Before Storage, μm | 2.5 | 2.8 | 1.9 | 2.3 | 2.5 | 2.0 | 2.2 | 2.9 | 2.1 | 2.4 | 2.2 |

TABLE 4-continued

| | Ex. 1 | Ex. 2 | Ex. 3 | Ex. 4 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|---|
| $D_{50}$ After Storage, μm | 2.5 | 2.8 | 1.9 | 14 | 2.5 | 2.1 | 2.5 | Solidified | 3.8 | 2.9 | 2.5 |
| Difference of $D_{50}$ Before and After Storage, μm | 0 | 0 | 0 | 0.1 | 0 | 0.1 | 0.3 | — | 1.7 | 0.5 | 0.3 |

TABLE 5

| | | Ex. 5 | Ex. 6 | Ex. 7 | Ex. 8 |
|---|---|---|---|---|---|
| Physical Properties of Liquid Developer | Viscosity of Liquid Developer, mPa · s | 20 | 18 | 35 | 12 |
| | $D_{50}$ of Toner Particles, μm | 2.5 | 2.3 | 2.9 | 2.0 |
| Evaluation of Liquid Developer | Lowest Fusing Temperature, ° C. | 80 | 80 | 80 | 80 |
| | Highest Fusing Temperature, ° C. | 130 | 150 | 160 | 120 |
| | Control of Corona Charger Contamination | A | A | A | A |
| | Generation Time of Corona Charger Contamination, minute | — | — | — | — |
| | Pulverizability | C | B | C | B |
| | $D_{50}$ Before Storage, μm | 2.5 | 2.3 | 2.9 | 2.0 |
| | $D_{50}$ After Storage, μm | 2.5 | 2.3 | 2.9 | 2.0 |
| | Difference of $D_{50}$ Before and After Storage, μm | 0 | 0 | 0 | 0 |

It can be seen from the above results that the liquid developers of Examples 1 to 8 have excellent low-temperature fusing ability, storage stability, and pulverizability, and also further have controlled corona charger contamination.

On the other hand, the liquid developers of Comparative Examples 1 to 7 have high evaporation rates, and corona charger contamination is generated.

Further, it can be seen from the comparisons of Examples 5 to 7 with Example 8 that a liquid developer containing a resin using a tricarboxylic acid compound has an improved hot offset resistance.

The liquid developer of the present invention is suitably used, for example, in development or the like of latent images formed in electrophotography, electrostatic recording method, electrostatic printing method or the like.

The invention claimed is:

1. A liquid developer comprising toner particles comprising a resin comprising a polyester and a pigment, wherein the toner particles are dispersed in an insulating liquid in the presence of a dispersant, wherein the insulating liquid has an evaporation rate after holding at 40° C. for 30 minutes of less than 0.26% by mass, and wherein the dispersant comprises a basic dispersant having an imino group.

2. The liquid developer according to claim 1, wherein a difference between an initial boiling point and a dry point of the insulating liquid is 30° C. or lower.

3. The liquid developer according to claim 1, wherein the insulating liquid comprises a naphthene hydrocarbon.

4. The liquid developer according to claim 1, wherein the polyester is obtained by polycondensing an alcohol component comprising a dihydric or higher polyhydric alcohol and a carboxylic acid component comprising a dicarboxylic or higher polycarboxylic acid compound.

5. The liquid developer according to claim 4, wherein the dihydric or higher polyhydric alcohol is an aliphatic diol having 2 to 20 carbon atoms.

6. The liquid developer according to claim 1, wherein the softening point of the polyester is 70° C. to 160° C.

7. The liquid developer according to claim 1, wherein the basic dispersant is a compound having a polyimine.

8. The liquid developer according to claim 7, wherein the compound having a polyimine is a condensate of a polyimine and a carboxylic acid.

9. The liquid developer according to claim 7, wherein the polyimine is polyethyleneimine, and the number of moles added for ethyleneimine is 10 to 1,000.

10. The liquid developer according to claim 8, wherein the carboxylic acid is a saturated or unsaturated aliphatic carboxylic acid having 10 to 30 carbon atoms.

11. The liquid developer according to claim 1, wherein the conductivity of the insulating liquid is $1.0\times10^{-13}$ S/m to $1.0\times10^{-11}$ S/m.

12. The liquid developer according to claim 1, wherein the initial boiling point of the insulating liquid is 250° C. to 320° C.

13. The liquid developer according to claim 1, wherein the dry point of the insulating liquid is 250° C. to 350° C.

14. The liquid developer according to claim 1, wherein the insulating liquid comprises a naphthene hydrocarbon, wherein the content of the naphthene hydrocarbon is 5% by mass to 80% by mass of the insulating liquid.

15. The liquid developer according to claim 1, wherein the viscosity of the liquid developer at 25° C. is 3 mPa·s to 50 mPa·s.

16. A method of use of an insulating liquid as a medium for a liquid developer comprising toner particles comprising a resin comprising a polyester and a pigment, wherein the toner particles are dispersed in an insulating liquid in the presence of a dispersant, wherein the insulating liquid has an evaporation rate after holding at 40° C. for 30 minutes of less than 0.26% by mass, and wherein the dispersant comprises a basic dispersant having an imino group.

17. A method for producing a liquid developer comprising toner particles comprising a resin comprising a polyester and a pigment, wherein the toner particles are dispersed in an insulating liquid in the presence of a dispersant, comprising:

melt-kneading a resin comprising a polyester and a pigment, and pulverizing a kneaded product obtained, to obtain toner particles;

adding a dispersant to the obtained toner particles, and dispersing the toner particles in an insulating liquid to obtain a dispersion of toner particles, and subjecting the obtained dispersion of toner particles to wet-milling, to obtain a liquid developer, wherein the insulating liquid has an evaporation rate after holding at 40° C. for 30 minutes of less than 0.26% by mass, and wherein the dispersant comprises a basic dispersant having an imino group.

* * * * *